US005898979A

United States Patent [19]

Hamada

[11] Patent Number: 5,898,979

[45] Date of Patent: May 4, 1999

[54] LOCKING SLIDE FASTENER SLIDER

[75] Inventor: Yoshikazu Hamada, Toyama-ken, Japan

[73] Assignee: YKK Corporation, Tokyo, Japan

[21] Appl. No.: 09/084,875

[22] Filed: May 28, 1998

[30] Foreign Application Priority Data

May 30, 1997 [JP] Japan ..... 9-141735

[51] Int. Cl.[6] ..... A44B 19/30

[52] U.S. Cl. ..... 24/418

[58] Field of Search ..... 24/418–425

[56] References Cited

U.S. PATENT DOCUMENTS 2,901,803 9/1959 Porepp .
4,409,705 10/1983 Yuunaga .
5,329,674 7/1994 Tomita et al. .
5,528,802 6/1996 Akashi .
5,628,094 5/1997 Mizuno .

FOREIGN PATENT DOCUMENTS 2238584 2/1973 Germany ..... 24/419

*Primary Examiner*—James R. Brittain
*Attorney, Agent, or Firm*—Hill & Simpson

[57] ABSTRACT

In a locking slide fastener slider, an upper wing has on its lower surface a central ledge extending from a guide post to the rear end so as to define a pair of side recesses one on each side of the central ledge. The central ledge has a large-width portion extending from around a base of the guide post and terminating midway to the rear end an intermediate tapering portion contiguous to the large-width portion, and a small-width portion extending from the tapering portion to the rear end. An inclined slope is formed along the boundary of the central ledge and one of side recesses. A locking-pawl-insertion through-hole extends transversely from the central ledge into one side recess across the slope.

11 Claims, 10 Drawing Sheets

LOCKING SLIDE FASTENER SLIDER

BACKGROUND OF THE INVENTION

1. Field of the Invention

This invention relates to a locking slide fastener slider of automatic, semi-automatic or manual type, and more particularly to the shape of a locking-pawl-insertion through-hole, which is part of a locking mechanism on a slider body.

2. Description of the Related Art

In some of conventional locking sliders of the automatic, semi-automatic or manual type, a locking-pawl-insertion through-hole in the form of a square slot is located in a central ledge extending on the lower surface of an upper wing from a guide post to the rear end of a guide channel in which a pair of rows of fastener elements is to be guided. And in others of the conventional locking sliders, such locking-pawl-insertion through-hole is located in one of opposite side recesses, one on each side of the central ledge, in the lower surface of the upper wing.

Japanese Utility Model Laid-Open Publication No. Sho 57-7313 discloses a locking slider as shown in FIG. 11 of the accompanying drawings of the present specification. In this slider, a square locking-pawl-insertion through-hole 15' is located about a center of a central ledge 10' on the lower surface of an upper wing 2', and a plate-like locking pawl 21' is automatically inserted into a space between adjacent legs of one of opposed rows of fastener elements being coupled together in a guide channel 6' of a slider body 1' to temporarily stop the sliding of the slider.

U.S. Pat. No. 2,901,803 discloses a locking slider as shown in FIG. 12 of the accompanying drawings of the present specification. In this slider, a rectangular locking-pawl-insertion through-hole 15" is located in one of opposite side recesses 9" at a position toward the rear end of the guide channel 6", off a central ledge 10" on the lower surface of the upper wing 2", and a longitudinally elongated locking pawl 21" is inserted into the locking-pawl-insertion through-hole 15" to automatically press the legs of one of opposed rows of fastener elements being coupled together in the guide channel 6" of a slider body 1", thus temporarily stop the slider.

In either locking slider of the above-named publications, partly since the locking pawl presses the legs of the coupled fastener elements or is inserted into a space between adjacent legs at a position in the central ledge or in the one side recess to automatically stop the sliding of the slider, and partly since the locking-pawl-insertion through-hole is located in a flat area, possible influence on the fastener elements due to the locking-pawl-insertion through-hole would not be very much.

Whereas in the locking slider according to this invention, the locking-pawl-insertion through-hole is located in and across the boundary between the central ledge and one of opposite side recesses in the guide channel. Either of the above-named prior art publications is totally silent about this concept. Still, with a hypothetical combination of the locking-pawl-insertion through-holes of these prior art forms, a squared step was created in the locking-pawl-insertion through-hole at the boundary between the central ledge and the side recess and due to this stepped locking-pawl-insertion through-hole, the frictional resistance of the fastener elements would become large so that smooth sliding of the slider could not be realized and the fastener elements would be damaged by the locking-pawl-insertion through-hole. Having the surfaces of the legs of the fastener elements with scratches, the slide fastener would be unsightly.

SUMMARY OF THE INVENTION

It is therefore a first object of the invention to provide an autolock, semi-autolock or manual-lock slide fastener slider which can reduce an influence on fastener elements and can slide smoothly even though a locking-pawl-insertion through-hole extends across a step between a central ledge and a side recess on the lower surface of an upper wing, thus keeping the fastener elements neat in appearance free from any damage such as scratch during repeated use.

A second object of the invention is to provide an autolock, semi-autolock or manual-lock slide fastener slider which can minimize a possible frictional resistance of fastener elements on the lower surface of the upper wing around the locking-pawl-insertion through-hole, thus guiding the fastener elements smoothly.

A third object of the invention is to provide an autolock, semi-autolock or manual-lock slide fastener slider whose upper wing has on its lower side a guide surface suitable particularly to a fastener chain with opposed fastener element rows made of thermoplastic synthetic monofilaments, thus enabling smooth and reliable guiding of the fastener elements without damage such as scratch.

A fourth object of the invention is to provide an autolock, semi-autolock or manual-lock slide fastener slider which has a unique locking-pawl-insertion through-hole suitable to a fastener chain with opposed fastener element rows made of thermoplastic synthetic monofilaments and optimal to a plate-like locking pawl.

A fifth object of the invention is to provide a semi-autolock or manual-lock slide fastener slider which has a unique locking-pawl-insertion through-hole suitable to a fastener chain having opposed fastener element rows made of thermoplastic synthetic monofilaments and optimal to a locking pawl projecting perpendicularly from a pull tub near its axle.

A sixth object of the invention is to provide an autolock, semi-autolock or manual-lock slide fastener slider which has a unique locking-pawl-insertion through-hole suitable particularly to a locking pawl pivotally movable transversely of the slider body.

A seventh object of the invention is to provide an autolock, semi-autolock or manual-lock slide fastener slider in which the locking-pawl-insertion through-hole is located in such a position that fastener elements can be very easily deformed and the locking pawl can simply insert between legs of the fastener elements, thus enabling smooth locking operation An eighth object of the invention is to provide an autolock, semi-autolock or manual-lock slide fastener slider in which a locking pawl suitable to a locking-pawl-insertion through-hole extending across a slope between a central ledge and a side recess is pivotally movable about the axis longitudinal of the slider body, thus enabling a reliable and efficient locking function and a smooth movement on the fastener chain.

A ninth object of the invention is to provide an autolock slide fastener slider in which a locking pawl suitable to a locking-pawl-insertion through-hole extending across a slope between a central ledge and a side recess is able to retractably project into the guide channel automatically and resiliently, thus enabling a reliable and efficient locking function and a smooth movement on the fastener chain.

A tenth object of the invention is to provide a semi-autolock or manual-lock slide fastener slider in which a locking pawl suitable to a locking-pawl-insertion through-hole extending across a slope between a central ledge and a side recess is able to retractably project into the guide channel, thus enabling a reliable and efficient locking function and smooth movement on the fastener chain.

According to a first aspect of the invention, the first object is accomplished by an autolock, semi-autolock or manual-lock slide fastener slider comprising a slider body, a pull tab and a locking mechanism as follows. The slider body composed of upper and lower wings joined at their front ends by a guide post so as to define between the upper and lower wings a guide channel. The upper wing has a locking-pawl-insertion through-hole communicating with the guide channel. The pull tab is connected to the slider body. The locking mechanism is supported by the upper wing and includes a locking pawl inserted in the locking-pawl-insertion through-hole for retractably projecting into the guide channel in an automatic, semi-automatic or manual action. The upper wing has on its lower surface a central ledge extending from the guide post to a rear end of the guide channel. It defines in the lower surface of the upper wing a pair of side recesses one on each side of the central ledge. The locking-pawl-insertion through-hole extends transversely from the central ledge into one of the side recesses. The lower surface of the upper wing further comprises a slope extending along a boundary of the central ledge and the one side recess.

According to a second aspect of the invention, the central ledge has a large-width portion, an intermediate tapering portion, and a small-width portion. The large-width portion extends, by a uniform width, from a protuberance which is formed around a base of the guide post and terminates midway to the rear end of the guide channel. The intermediate tapering portion is contiguous to the large-width portion and gradually decreases in width toward and terminates short of the rear end of the guide channel. And the small-width portion contiguous to the intermediate tapering portion and extending to the rear end of the guide channel by a uniform width.

According to a third aspect of the invention, the protuberance and the central ledge have a flat surface for covering a possible path of successive coupling heads of opposed rows of filamentary fastener elements. Also, the slope extends along the large-width portion of the central ledge forward and rearward of the locking-pawl-insertion through-hole for covering a possible path of successive legs of one row of the fastener elements.

According to a fourth aspect of the invention, the locking-pawl-insertion through-hole extends transversely from the small-width portion of the central ledge into the one side recess. The slope extends forward and rearward of the locking-pawl-insertion through-hole and contiguously connects the one side recess with the large-width and small-width portions of the central ledge.

According to a fifth aspect of the invention, the locking-pawl-insertion through-hole is in the form of a slot extending longitudinally of the slider body. The slope extends forward and rearward of the locking-pawl-insertion through-hole.

According to a sixth aspect of the invention, the locking-pawl-insertion through-hole is in the form of a rectangular slot extending perpendicularly across the longitudinal center line of the central ledge.

According to a seventh aspect of the invention, the locking-pawl-insertion through-hole covers or extends close to a possible meeting point of opposed rows of the successive coupling heads of the fastener elements.

According to a eighth aspect of the invention, the locking pawl is supported on the upper wing for pivotal movement about the axis extending longitudinally of the slider body to pivotally project into and retract from the guide channel.

According to a ninth aspect of the invention, the locking pawl is one end of a leaf spring and normally projects into the guide channel under the resiliency of the leaf spring.

According to a tenth aspect of the invention, a pull tab having at one end a transverse axle is supported on the upper wing for pivotal movement about the axle. The pull tab has, at its one end adjacent to said axle, the locking pawl which is projecting perpendicularly from the pull tab and which is pivotally movable about the axle to pivotally and retractably project into the guide channel in response to the pivotal movement of the pull tab.

DETAILED DESCRIPTION OF THE PREFERRED EMBODIMENTS

Various preferred embodiments of this invention will now be described in detail with reference to the accompanying drawings.

Figure 1:
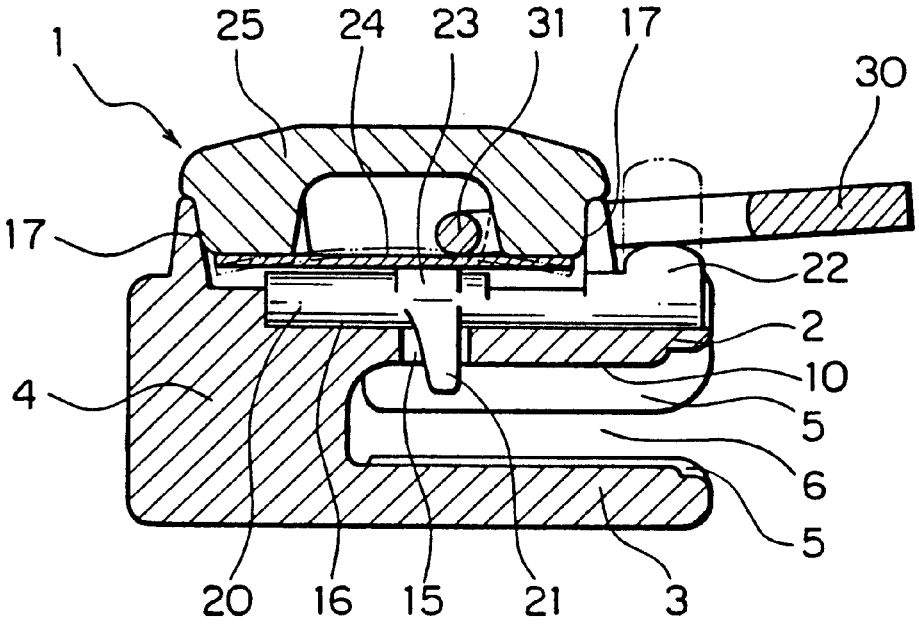
FIG. 1 is a longitudinal cross-sectional view of a semi-autolock slide fastener slider according to a first embodiment of this invention.
Figure 5:
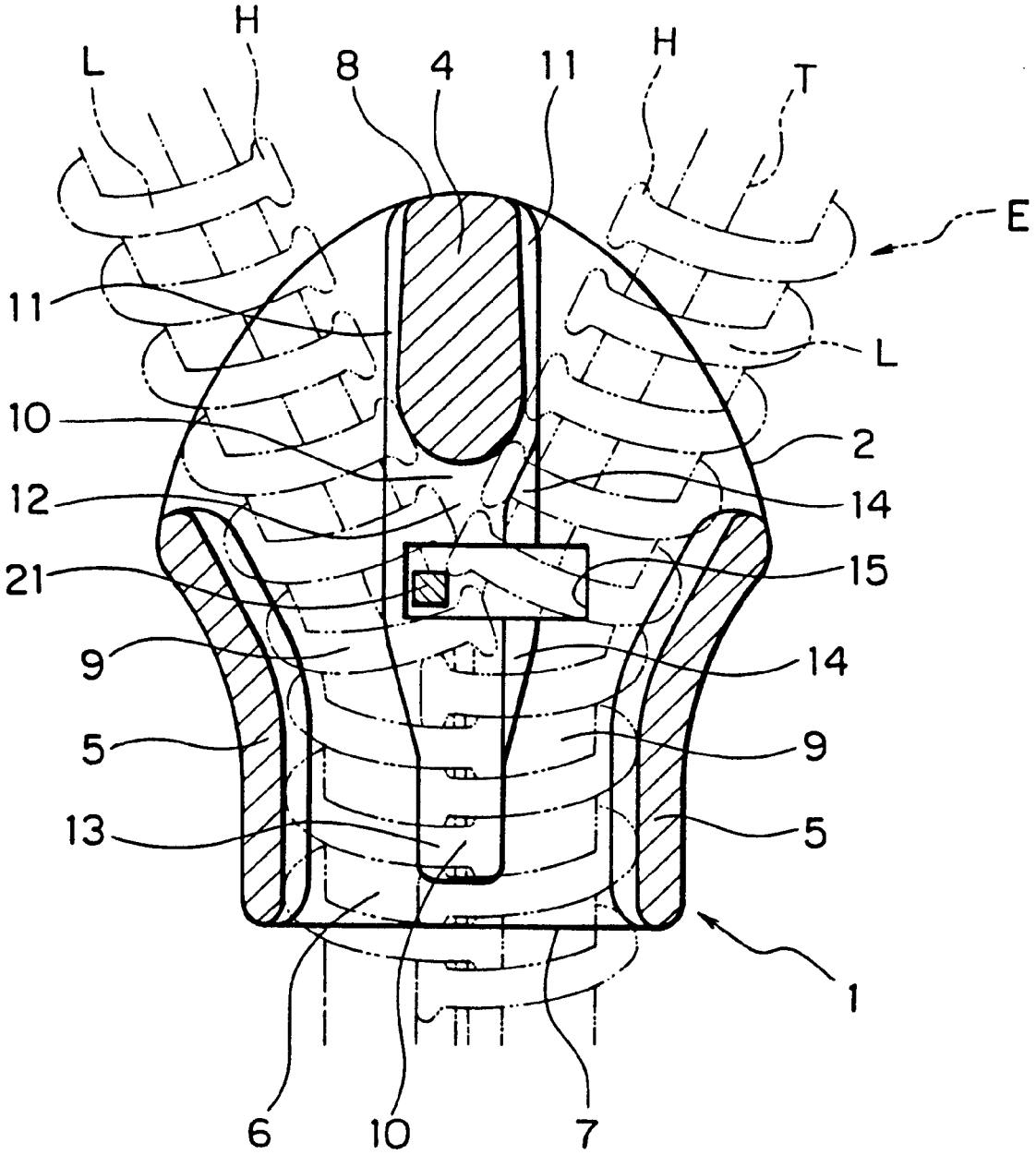
FIG. 5 is a partly cross-sectional bottom plan view showing the slider as threaded on a fastener chain.

FIG. 1 shows a locking slide fastener slider according to a first embodiment of the invention. In this slider, a slider body 1 is composed of upper and lower wings 2, 3 joined at their front ends by a guide post 4 and each having a pair of guide flanges 5 bent from its opposite side edges so as to define between the upper and lower wings 2, 3 a guide channel 6. Preferably the slider body 1 is molded of metal such as aluminum or zinc alloy by die casting. The upper wing 2 or the lower wings 3 may be devoid of the guide flanges 5, and alternatively the guide flanges 5 of one wing may be lower in height than those of the other wing. For an illustrative example, a fastener chain being used here includes, as shown in FIG. 5, a pair of fastener tapes and a pair of fastener element rows E, each in the form of a coiled thermoplastic monofilament, attached to confronting longitudinal edges of the fastener tapes by sewing threads T; consequently, the guide flanges 5 of the lower wing 3 are lower in height than those of the upper wing 2.

Figure 3:
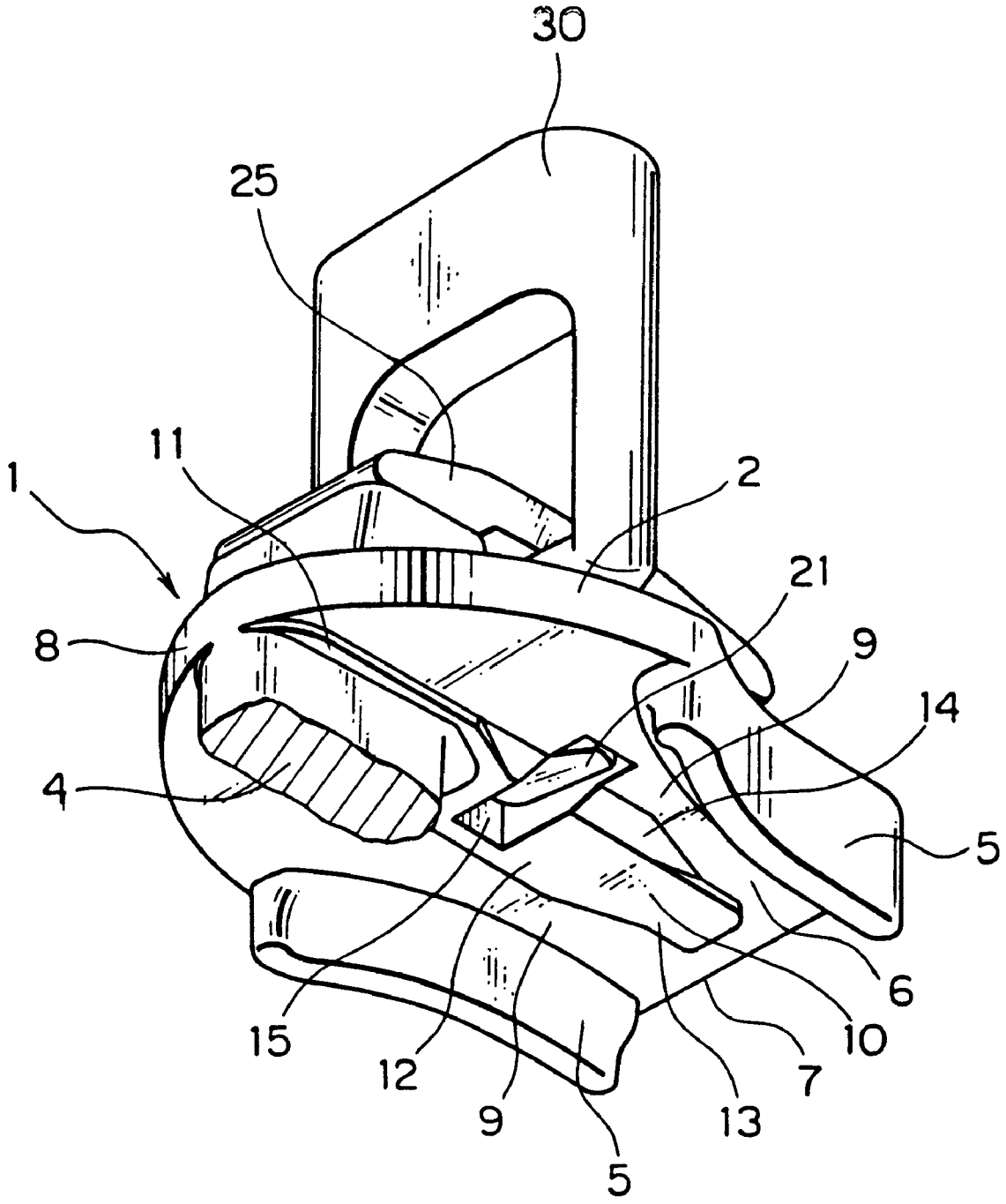
FIG. 3 is a perspective view, with parts broken away, of the slider of the first embodiment, showing the inside of a slider.
Figure 4:
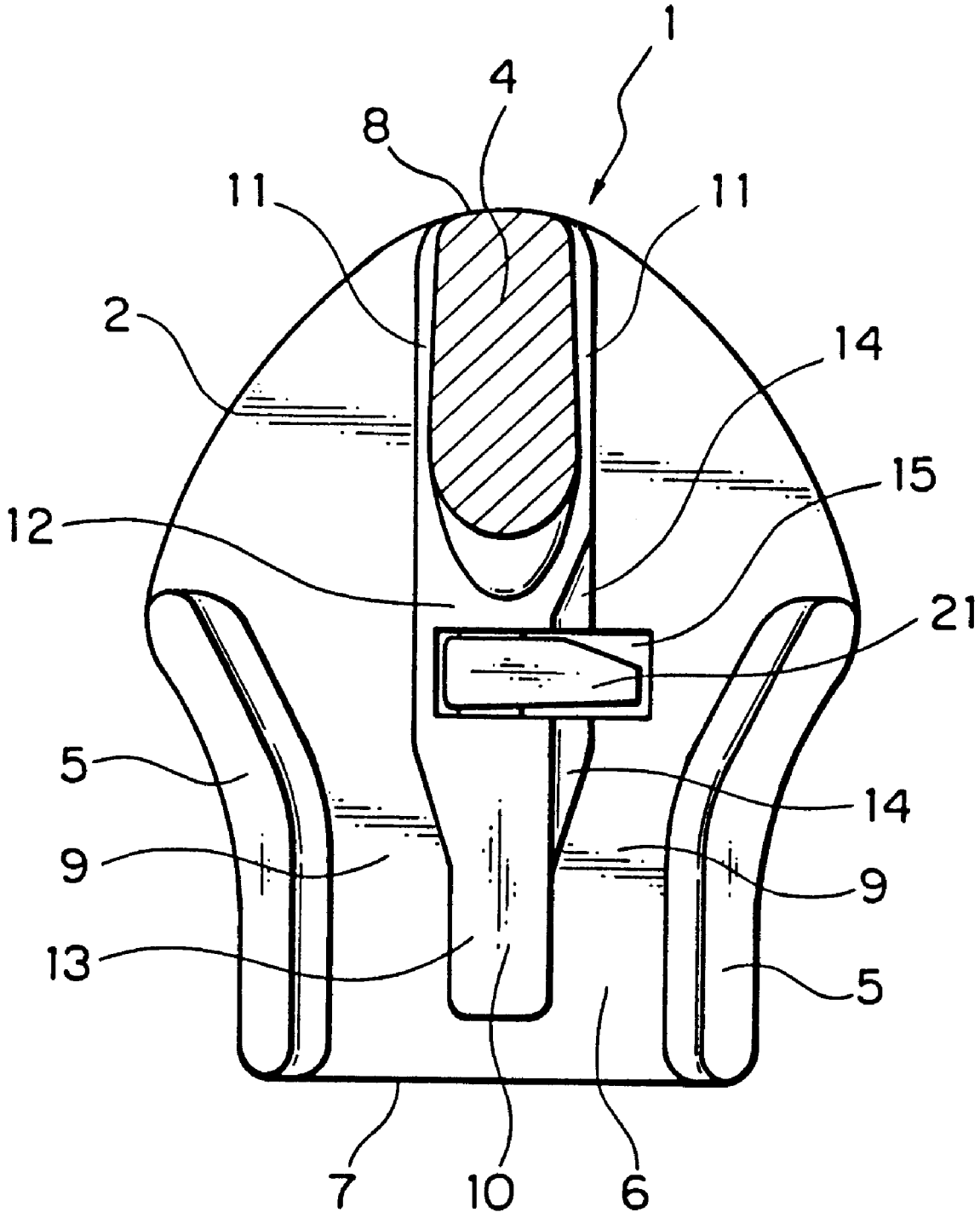
FIG. 4 is a bottom plan view corresponding to FIG. 3.

The upper wing 2 has, as shown in FIGS. 3 and 4, on its lower surface a central ledge 10 extending from around the base of the guide post 4 toward a rear end 7 of the guide channel 6. The central ledge 10 is in contact with successive coupling heads H of the fastener elements E and serves to guide the sewing threads T holding successive legs L, as shown in FIG. 5. The central ledge 10 has a large-width portion 12 extending from a protuberance 11 which is formed around the base of the guide post 4 and terminating substantially midway to the rear end 7 of the guide channel 6, an intermediate tapering portion contiguous to the large-width portion 12 and decreasing in width toward the rear end 7, and a small-width portion 13 extending from the intermediate tapering portion to the rear end 7.

Figure 6:
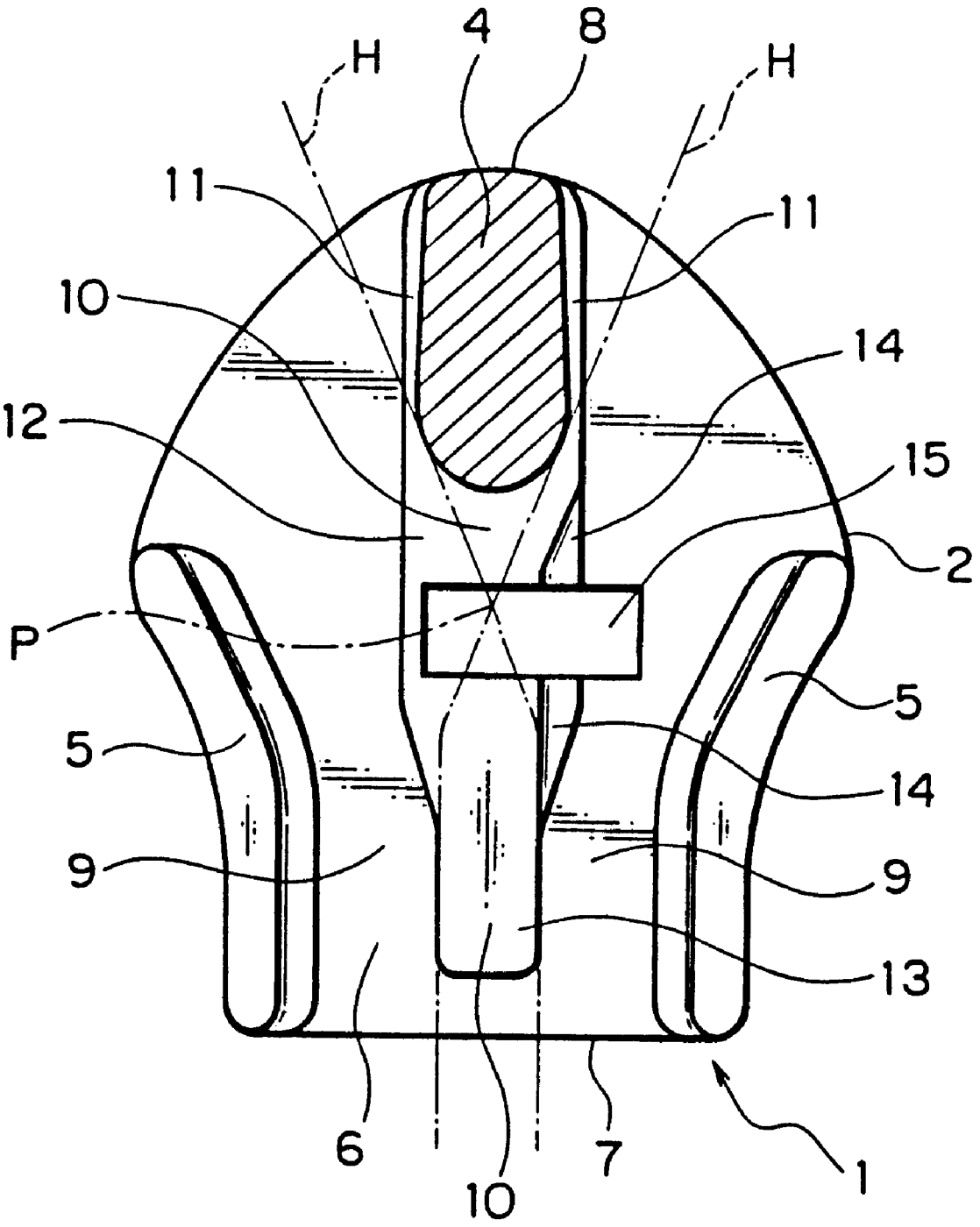
FIG. 6 is a partly cross-sectional bottom plan view showing the lower surface of an upper wing of the slider of the first embodiment.

The central ledge 10 contiguous to the protuberance 11 has a flat surface for covering a possible path of the successive coupling heads H of opposed rows of the fastener elements E. As shown in FIG. 6, the upper wing 2 has a locking-pawl-insertion through-hole 15 in the form of a rectangular slot communicating with the guide channel 6 and extending from one of the side recesses 9 to the central ledge 10 perpendicularly across the longitudinal central line of the central ledge 10 and passing a possible meeting point P of opposed rows of the successive coupling heads H of the fastener elements E.

The lower surface of the upper wing 2 has also a gentle slope 14 extending along a boundary of the central ledge 10 and the one side recess 9. The slope 14 laterally inclined from the central ledge 10 toward the one side recess 9 so as to contiguously connect them. Specifically, the slope 14 extends from the large-width portion 12 and the intermediate tapering portion through their entire length longitudinally of the slider body 1. The slope 14 is divided into front and rear parts by the locking-pawl-insertion through-hole 15 and contiguous to the large-width portion 12 and the intermediate tapering portion, respectively, so as not to cover the possible path of the coupling heads H of the fastener elements E. Thus there exists no squared step between the central ledge 10 and the one side recess 9 at either of front and rear sides of the locking-pawl-insertion through-hole 15. Accordingly, in the absence of such a step of the locking-pawl-insertion through-hole 15, when the fastener elements E are guided by the central ledge 10 in response to movement of the slider body 1 along the fastener chain, the legs L smoothly slide without receiving any possible impact from the locking-pawl-insertion through-hole 15 and therefore the legs L are kept free from any damage such as scratch.

Figure 2:
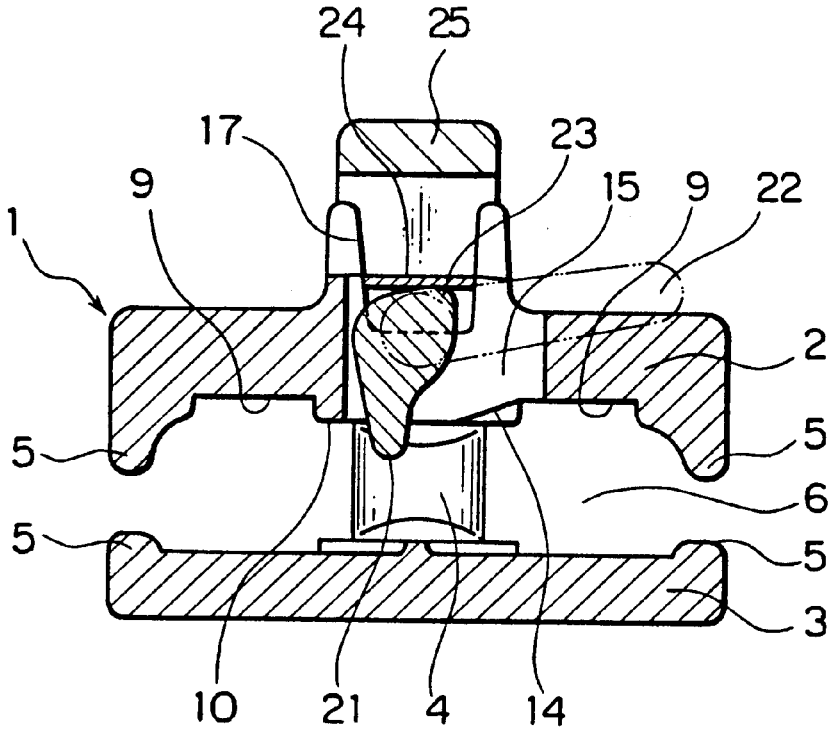
FIG. 2 is a transverse cross-sectional view of the slider of the first embodiment.

FIGS. 1 and 2 show an example to which the foregoing locking-pawl-insertion through-hole 15 of the upper wing 2 is optimal. In this slider, the slider body 1 has in an upper surface of the upper wing 2 a longitudinally extending central groove 16 in which a manipulating lever 20 is received. The manipulating lever 20 is in the form of a rod-like shaft having at its rear end a tab 22 and the locking pawl 21 projecting from a substantially central position of the manipulating lever 20 in a direction perpendicular to both the manipulating lever 20 and the tab 22. On its peripheral surface opposite to the locking pawl 21, the manipulating lever 20 has a cam 23 against which a leaf spring 24 is resiliently pressed. The manipulating lever 20 together with the leaf spring 24 is concealed by a cover 25 to which a pull tab 30 is pivotally attached. Thus the semi-autolock slider is completed whose locking function will be described as follows:

In operation, when the manipulating lever 20 is turned about its axis from a phantom-line position to a solid-line position in FIG. 1 by gripping the tab 22, the locking pawl 21 pivotally projects into the guide channel 6 via the locking-pawl-insertion through-hole 15 to penetrate between the legs L of the fastener elements E (see FIG. 5) under the resilience of the spring 24, thus stopping sliding of the slider. Then when the manipulation lever 20 is turned back to the original position (counterclockwise in FIG. 2) against the resilience of the spring 24, the locking pawl 21 pivotally retracts from the legs L of the fastener elements E to release the slider so that the slider can be freely slid when pulled by the pull tab 30.

The locking-pawl-insertion through-hole 15 should preferably extend so as to cover a possible meeting point P of opposed rows of fastener elements E; although this feature is not a must. As long as the locking-pawl-insertion through-hole 15 exists close to the meeting point P, the condition to stop the slider is satisfied. The reasons why the locking-pawl-insertion through-hole 15 should preferably cover the meeting point P are that it would facilitate deforming the fastener elements E and that it would be convenient particularly if the locking pawl 21 is large in size and/or stroke.

Figure 7:
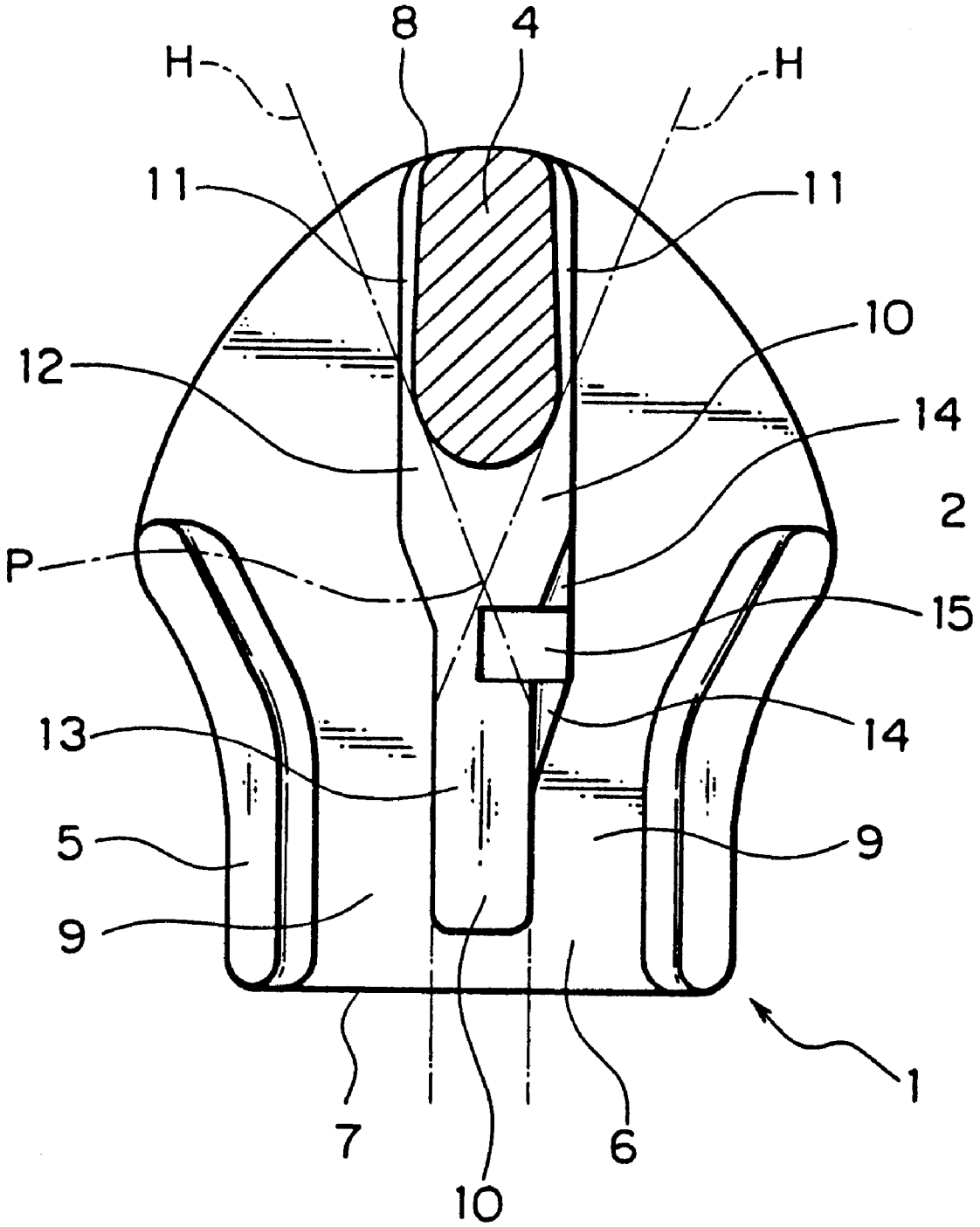
FIG. 7 is a partly cross-sectional bottom plan view of another semi-autolock slide fastener slider according to a second embodiment, showing the lower surface of an upper wing of the slider.

FIG. 7 shows another semi-autolock slider according to a second embodiment which is totally identical in structure with the first embodiment except that a substantially square locking-pawl-insertion through-hole 15 is located close to the possible meeting point P of opposed rows of fastener elements E and that, in a slope 14 which is divided into front and rear parts by the locking-pawl-insertion through-hole 15, the front part is gently sloping from the intermediate tapering portion of the central ledge 10 to the one side recess 9 and the rear part is sloping from the small-width portion 13 to the one side recess 9.

Figure 8:
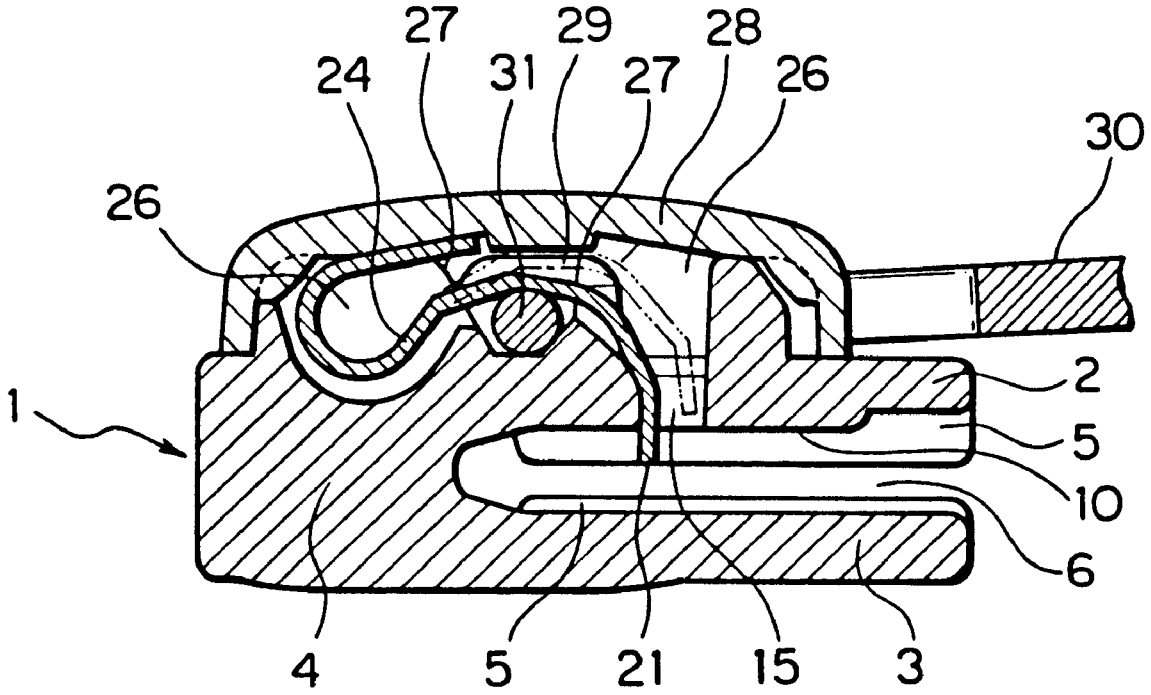
FIG. 8 is a longitudinal cross-sectional view of an autolock slide fastener slider according to a third embodiment.

FIG. 8 shows an autolock slider according to a third embodiment to which the foregoing locking-pawl-insertion through-hole 15 is adopted. In this slider, a slider body 1 has on an upper surface of the upper wing 2 an accommodation chamber 26 in which a U-shape leaf spring 24 having at one end a locking pawl 21 is received. The chamber 26 has centrally on its bottom a V-shape guide surface 27 f or rotatably supporting the axle 31 of the pull tab 30. The chamber 26 accommodating the leaf spring 24 inside is concealed by a boat form cover 28. The cover 28 has in opposite sides a pair of laterally aligned cutouts 29 through which the axle 31 of the pull tab 30 is inserted. Thus the autolock slider is completed.

In the thus assembled autolock slider, the locking pawl 21 is removed off the legs L of the fastener elements E (see FIG. 5) against the resilience of the spring 24 by pulling the pull tab 30, then the slider can slide on the fastener chain. Having the front and rear parts of the slope 14 located at the front and rear sides, respectively, of the locking-pawl-insertion through-hole 15, it is possible to guide the legs L of the fastener elements E smoothly without damage such as scratch.

Figure 9:
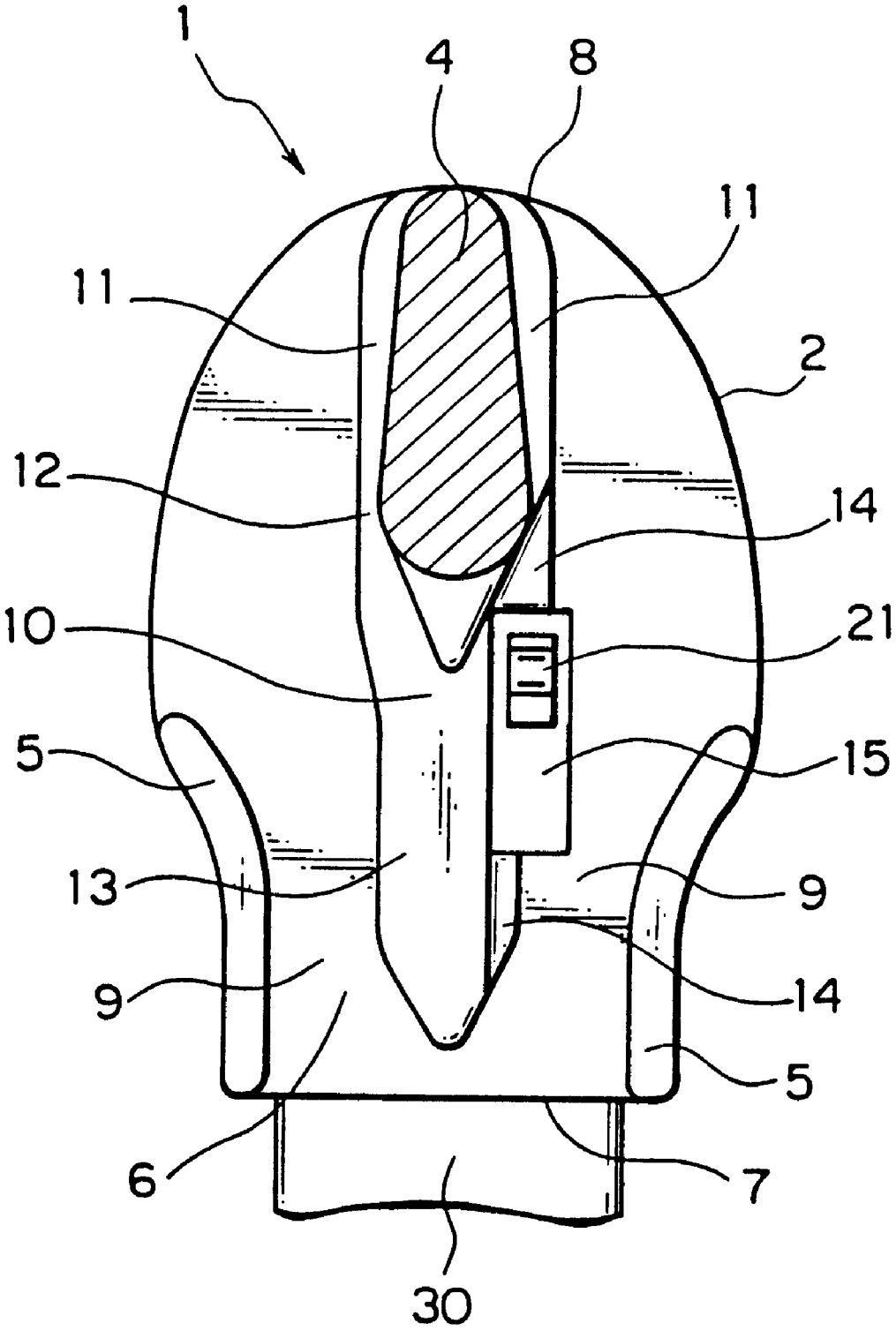
FIG. 9 a partly cross-sectional bottom plan view of still another semi-autolock slide fastener slider according to a fourth embodiment, showing the lower surface of an upper wing of the slider.

FIG. 9 shows still another semi-autolock slider according to a fourth embodiment which is identical in structure with the foregoing embodiments except that the locking-pawl-insertion through-hole 15 is in the form of an elongated rectangular slot extending parallel to the longitudinal center line of the central ledge 10 and located close to the possible meeting point P of opposed rows of fastener elements E (see FIG. 5) and that the slope 14 is separated by the locking-pawl-insertion through-hole 15 into front and rear parts each contiguous to the large-width and small-width portions 12, 13, respectively, of the central ledge 10 so as not to form any step between the central ledge 10 and the one side recess 9. This arrangement is suitable to a slider of the type in which the locking pawl 21 is pivotally movable about the transverse axis.

Figure 10:
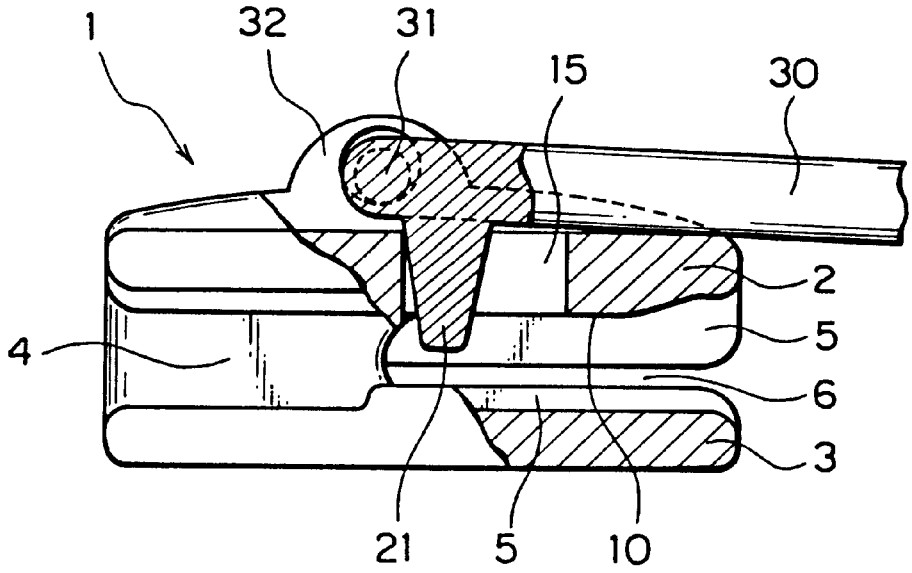
FIG. 10 is a side view, with parts broken away, of a manual-lock slide fastener slider according to a fifth embodiment.
Figure 11:
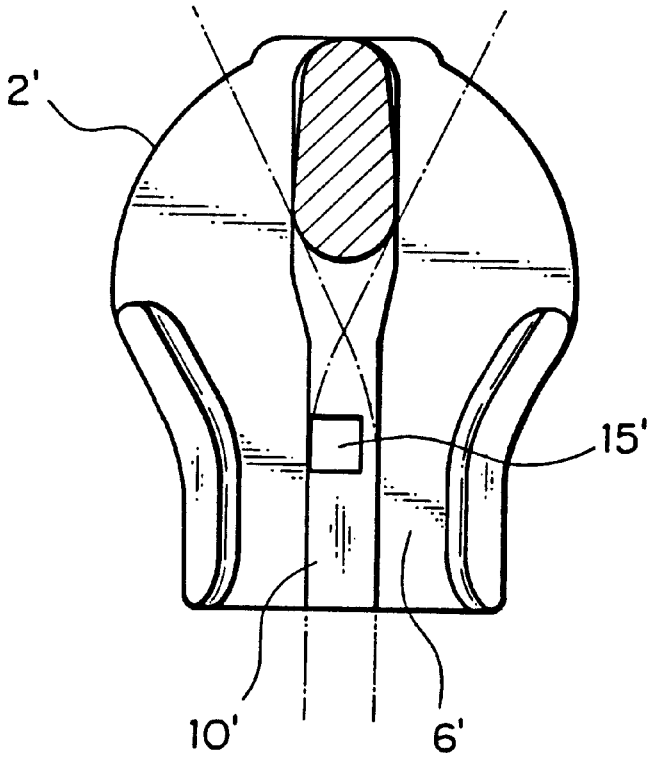
FIG. 11 PRIOR ART
FIG. 11 is a partly cross-sectional bottom plan view of a conventional autolock slide fastener slider, showing the lower surface of an upper wing of the slider.
Figure 12:
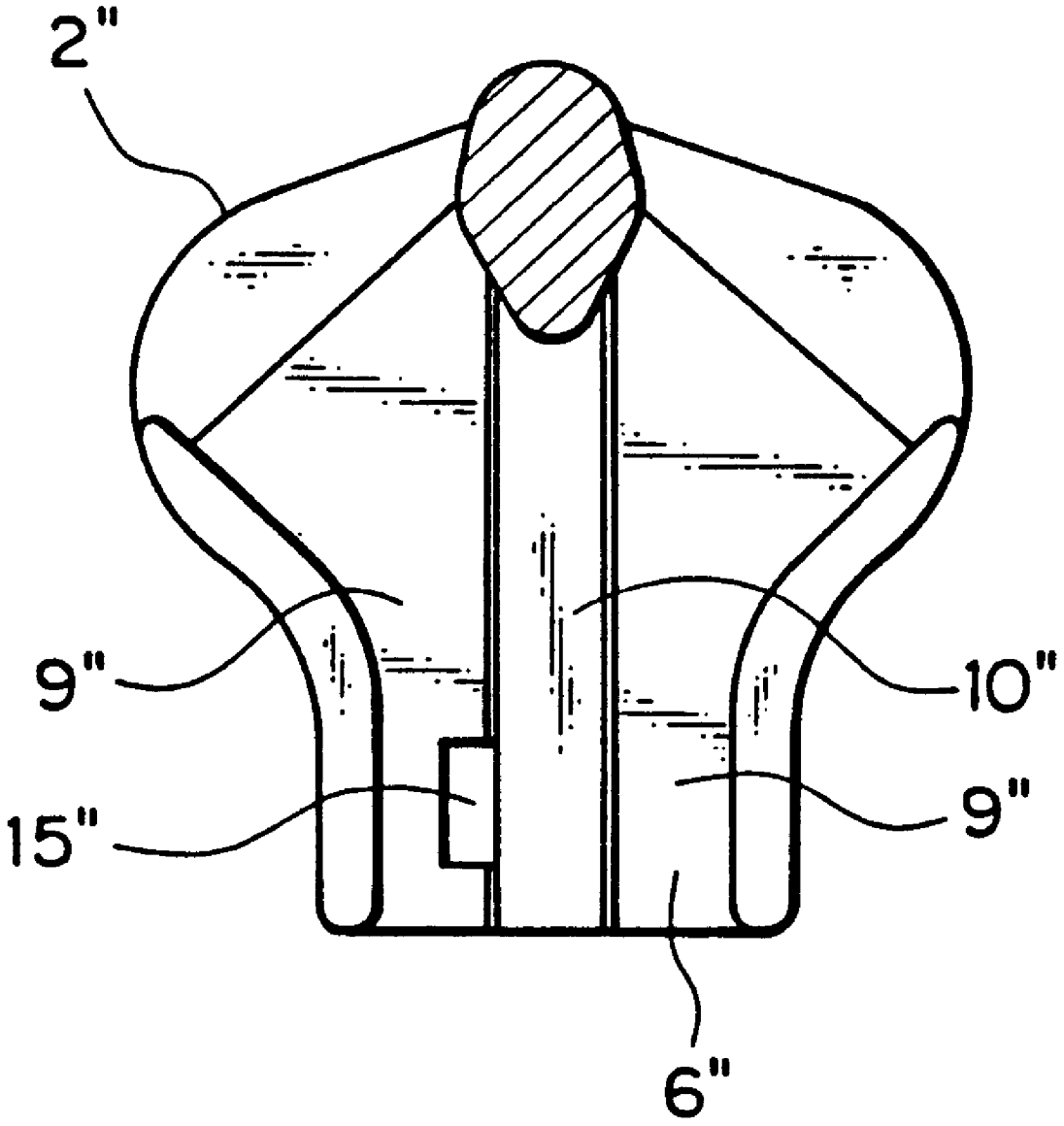
FIG. 12 PRIOR ART
FIG. 12 is a partly cross-sectional bottom plan view of another conventional autolock slide fastener slider, showing the lower surface of an upper wing of the slider.

This locking-pawl-insertion through-hole 15 of FIG. 9 is also suitable to a manual-lock slider according to a fifth embodiment of FIG. 10. In this manual-lock slider, an attachment lug 32 stands on the upper surface of the upper wing 2 and rotatably supports the axle 31 of the pull tab 30. And the locking pawl 21 projects perpendicularly from the pull tab 30 at a position near the axle 31 for insertion in the locking-pawl-insertion through-hole 15 to pivotally and retractably project into the guide channel 6 as the pull tab 30 is pivotally moved about the axle 31 transverse of the slider body 1.

Alternatively the pull tab 2 may have at the axle 31 a non-illustrated cam on which a non-illustrated leaf spring mounted in the upper wing 2 would rest, so that the pull tab 2 can be prevented from inadvertently taking an upright posture; thus this arrangement may be applied also to a semi-autolock slider. In operation, in either type locking slider, when the pull tab 30 is pulled to its upright posture, then the locking pawl 21 is removed off the legs L of the fastener elements E (see FIG. 5) to allow the slider to slide in either direction. To stop the slider, the pull tab 30 is turned to its horizontal posture to bring the locking pawl 21 into engagement with the legs L of the fastener elements E, thereby preventing the slider from inadvertently moving on the fastener chain.

In not-illustrated another alternative form, the locking-pawl-insertion through-hole 15 may extend from the small-width portion 13 into the one side recess 9 at a position off to the rear end 7. Also in this case, it is very important that the slope 14 should be located on either the front side or the rear side of the locking-pawl-insertion through-hole 15, so as not to form any step between the central ledge 10 and the one side recess 9, and that the shape of the slope 14 is located at one side of the large-width portion 12 of the central ledge 10 or in the one side recess 9, should be such that removing the cores from the molding templates can be facilitated when the slider body 1 is molded.

With the locking slider of this invention, it is possible to obtain the following advantageous results:

According to the first aspect of the invention, partly since the upper wing 2 has on its lower surface the central ledge 10 extending from the guide post 4 toward the rear end 7 of the guide channel 6 and has a locking-pawl-insertion through-hole 15 extending from the central ledge 10 into one of opposite side recesses 9, and partly since the slope 14 extends along the boundary of the central ledge 10 and the one side recess 9 across the locking-pawl-insertion through-hole 15, it is possible to eliminate every step on either of the front and rear s ides of the locking-pawl-insertion through-hole 15 so that the fastener elements E can slide smoothly along the entire guide channel 6, thus keeping the slider neat in appearance free from damage such as scratch, which would have been caused by a locking-pawl-insertion through-hole with a step, for repeated use.

According to the second aspect of the invention, since the central ledge 10 has the large-width portion 12 extending from the protuberance 11 around the base of the guide post 4 and terminating midway to the rear end 7 of the guide channel 6, the intermediate tapering portion contiguous to the large-width portion 11 and gradually decreasing in width toward and terminating short of the rear end 7 of the guide channel 6, and a small-width portion 13 contiguous to the intermediate tapering portion and extending to the rear end 7 of th e guide channel 6, it is possible to make the locking-pawl-insertion through-hole 15 in the central ledge 10 and the side recess 9 easily and to minimize a possible frictional resistance of fastener elements E on the lower surface of the upper wing 2 around the locking-pawl-insertion through-hole 15 and therefore to guide the fastener elements E smoothly.

According to the third aspect of the invention, partly since the protuberance 11 and the central ledge 10 have a flat surface for covering a possible path of successive coupling heads H of opposed rows of filamentary fastener elements E, and partly since the slope 14 extends along the large-width portion 12 of the central ledge 10 forward and rearward of the locking-pawl-insertion through-hole 15 for covering a possible path of successive legs L of one row of the fastener elements E, it is possible to guide the coupling heads H of the filamentary fastener elements E on a substantially flat surface through the entire length of the guide channel 6 as the stepped portion at either of the front and rear side of the locking-pawl-insertion through-hole 15 is compensated with the slope 14, thus securing a smooth movement of the slider.

According to the fourth aspect of the invention, partly since the locking-pawl-insertion through-hole 15 extends transversely from said small-width portion 13 of the central ledge 10 into the one side recess 9 and partly since the slope 14 extends forward and rearward of the locking-pawl-insertion through-hole 15 and contiguously connects the one side recess 9 with the large-width and small-width portions 12, 13 of said central ledge 10, it is possible to guide the legs L of the fastener elements E smoothly without damage such as scratch, even though the locking-pawl-insertion through-hole 15 is located in the small-width 13 portion of the central ledge 10.

According to the fifth aspect of the invention, since the locking-pawl-insertion through-hole 15 is in the form of a slot extending longitudinally of the slider body 1 and the slope 14 extends forward and rearward of the locking-pawl-insertion through-hole 15, the locking pawl 21 can easily be pivotally moved about the axis transverse of the slider body 1, and the fastener elements E can be guided smoothly without damage because of the slope 14 existing on either of the front and rear sides of the locking-pawl-insertion through-hole 15.

According to the sixth aspect of the invention, since the locking-pawl-insertion through-hole 15 is in the form of a rectangular slot extending perpendicularly across the longitudinal center line of the central ledge 10, the locking pawl 21 can be pivotally moved about the axis longitudinal of the slider body 1 smoothly with maximum ease.

According to the seventh aspect of the invention, since the locking-pawl-insertion through-hole 15 covers or extends close to a possible meeting point P of opposed rows of the successive coupling heads H of the fastener elements E, it is possible to insert the locking pawl 21 into a space between adjacent legs L of the fastener elements E very easily even if the locking pawl 21 is large in size, thus securing a reliable locking function.

According to the eighth aspect of the invention, since the locking pawl 21 is supported on said upper wing 2 for pivotal movement about the axis extending longitudinally of said slider body 1, the locking pawl 21 suitable to the locking-pawl-insertion through-hole 15 with the slope 14 on each of its front and rear sides can be pivotally and retractably project into the guide channel 6, thus enabling a reliable and efficient locking function and a smooth movement on the fastener chain as possible impacts due to a locking-pawl-insertion through-hole with a step are absorbed.

According to the ninth aspect of the invention, since the locking pawl 21 is one end of a leaf spring 24 and normally projects into the guide channel 6 under the resiliency of the leaf spring 24, the locking pawl 21 suitable to the locking-pawl-insertion through-hole 15 with the slope 14 on each of its front and rear sides can be urged normally to project into the guide channel 6 automatically and resiliently, thus enabling a reliable and efficient locking function and a smooth movement on the fastener chain as possible impacts due to a locking-pawl-insertion through-hole with a step are absorbed.

According to the tenth aspect of the invention, partly since the pull tab 30 having at one end the transverse axle 31 is supported on the upper wing 2 for pivotal movement about the axle 31, and partly since the pull tab 30 has, at its one end adjacent to the axle 31, the locking pawl 21 which is projecting perpendicularly from the pull tab 30 and which is pivotally movable about the axle 31 to pivotally and retractably project into the guide channel 6 in response to the pivotal movement of the pull tab 30, the locking pawl 21 suitable to the locking-pawl-insertion through-hole 15 with the slope 14 at each of its front and rear sides can be pivotally moved about the axis transverse of the slider body 1 in a manual or semi-automatic action, thus enabling a reliable and efficient locking function and smooth movement on the fastener chain as possible impacts due to a locking-pawl-insertion through-hole with a step are absorbed.

What is claimed is:

1. A locking slide fastener slider comprising:

(a) a slider body composed of upper and lower wings joined at their front ends by a guide post so as to define between said upper and lower wings a guide channel, said upper wing having a locking-pawl-insertion through-hole communicating with said guide channel;

(b) a pull tab connected to said slider body; and (c) a locking mechanism supported by said upper wing and including a locking pawl inserted in said locking-pawl-insertion through-hole for retractably projecting into said guide channel in an automatic, semi-automatic or manual action;

(d) said upper wing having on its lower surface a central ledge extending from said guide post to a rear end of said guide channel so as to define in said lower surface of said upper wing a pair of side recesses one on each side of said central ledge;

(e) said locking-pawl-insertion through-hole extending through said central ledge and transversely from said central ledge into one of said side recesses;

(f) said lower surface of said upper wing further having a slope extending along a boundary of said central ledge and said one side recess.

2. A locking slide fastener slider according to claim 1, wherein said central ledge has a large-width portion extending, by a uniform width, from a protuberance around a base of said guide and terminating midway to said rear end of said guide channel, an intermediate tapering portion contiguous to said large-width portion and gradually decreasing in width toward and terminating short of said rear end of said guide channel, and a small-width portion contiguous to said intermediate tapering portion and extending to said rear end of said guide channel by a uniform width.

3. A locking slide fastener slider according to claim 2, wherein said protuberance and said central ledge have a flat surface for covering a possible path of successive coupling heads of opposed rows of filamentary fastener elements, said slope extending along said large-width portion of said central ledge forward and rearward of said locking-pawl-insertion through-hole for covering a possible path of successive legs of one row of said fastener elements.

4. A locking slide fastener slider according to claim 2, wherein said locking-pawl-insertion through-hole extends transversely from said small-width portion of said central ledge into said one side recess and said slope extends forward and rearward of said locking-pawl-insertion through-hole and contiguously connects said one side recess with said large-width and small-width portions of said central ledge.

5. A locking slide fastener slider according to claim 4, wherein said locking pawl is one end of a leaf spring and normally projects into said guide channel under the resiliency of said leaf spring.

6. A locking slide fastener slider according to claim 1 or 4, wherein said locking-pawl-insertion through-hole is in the form of a slot extending longitudinally of said slider body and said slope extends forward and rearward of said locking-pawl-insertion through-hole.

7. A locking slide fastener slider according to claim 6, wherein the pull tab having at one end a transverse axle is supported on said upper wing for pivotal movement about said axle, and said pull tab has, at its one end adjacent to said axle, a locking pawl which is projecting perpendicularly from said pull tab and which is pivotally movable about said axle to pivotally and retractably project into said guide channel in response to said pivotal movement of said pull tab.

8. At A locking slide fastener slider according to claim 1, wherein said locking-pawl-insertion through-hole is in the form of a rectangular slot extending perpendicularly across the longitudinal center line of said central ledge.

9. At A locking slide fastener slider according to claims 8, wherein said locking pawl is supported on said upper wing for pivotal movement about an axis extending longitudinally of said slider body to pivotally and retractably project into said guide channel.

10. A locking slide fastener slider according to claim 1, wherein said locking-pawl-insertion through-hole covers or extends close to a possible meeting point of opposed rows of successive coupling heads of the fastener elements.

11. A locking slide fastener slider according to claim 1, wherein said central ledge has a flat surface for covering a possible path of successive coupling heads of opposed rows of filamentary fastener elements, said slope extending forward and rearward of said locking-pawl-insertion through-hole for covering a possible path of successive legs of one row of said fastener elements.

* * * * *